F6966 XR 4,460,373

United States Patent [19]

Beavan

[11] Patent Number: 4,460,373

[45] **Date of Patent: * Jul. 17, 1984**

[54] PARTICULATE DETERGENT COMPOSITION AND METHOD FOR CLEANING FABRICS

[75] Inventor: Stuart W. Beavan, Birkenhead, England

[73] Assignee: Lever Brothers Company, New York, N.Y.

[ * ] Notice: The portion of the term of this patent subsequent to Jun. 1, 1999 has been disclaimed.

[21] Appl. No.: 402,886

[22] Filed: Jul. 29, 1982

Related U.S. Application Data

[63] Continuation of Ser. No. 248,587, Mar. 27, 1981, abandoned.

[30] Foreign Application Priority Data

Apr. 11, 1980 [GB] United Kingdom ..... 8012042
Apr. 11, 1980 [GB] United Kingdom ..... 8012045

[51] Int. Cl.[3] ..... D06L 3/04; D06L 3/06

[52] U.S. Cl. ..... 8/103; 8/108 R; 252/95

[58] Field of Search ..... 8/103, 108 A; 252/103, 252/95, 96

[56] References Cited

U.S. PATENT DOCUMENTS

| | | | |
|---|---|---|---|
| 2,161,045 | 6/1939 | Hirschkind et al. | 8/103 |
| 3,836,475 | 9/1974 | Kirner | 8/108 |
| 4,033,818 | 7/1977 | Pourrat et al. | 424/195 |
| 4,104,190 | 8/1978 | Hartshorn | 8/108 A |

FOREIGN PATENT DOCUMENTS

| | | | |
|---|---|---|---|
| 50-6878 | 1/1975 | Japan | 8/103 |
| 0737127 | 2/1970 | United Kingdom | 8/103 |
| 1397595 | 6/1975 | United Kingdom | 8/103 |

*Primary Examiner*—Maria Parrish Tungol
*Attorney, Agent, or Firm*—Amirali Y. Haidri; James J. Farrell

[57] ABSTRACT

A method of bleaching fabrics comprises contacting the fabrics with a liquor containing a surfactant and a chlorite such as sodium chlorite and irradiating the fabric and/or the liquor with ultra-violet light derived from an artificial source or from daylight. The liquor has a pH ideally above 8.5. A UV-light exposure equivalent to 2 hours daylight gives good results. The liquor may contain a number of other components common in bleaching products. The composition is a particulate detergent composition comprising at least 1% by weight of surfactant, 0.1–40% by weight of chlorite and less than 20% by weight of water, yielding a pH of about 8.5–11 when dispersed in water at a concentration of 0.5–10 g/l. The compositions are stable on storage and the time and degree of bleaching can be controlled by control of the exposure to UV-light.

5 Claims, No Drawings

PARTICULATE DETERGENT COMPOSITION AND METHOD FOR CLEANING FABRICS

This is a continuation application of Ser. No. 248,587 filed Mar. 27, 1981 now abandoned.

This invention relates to a particulate detergent composition and method for laundering fabrics.

It is known to include bleaches in detergent compositions for cleaning fabrics. It is known for these bleaches to be photobleaches or to be bleaches activated by photosensitive bleach activators. For example U.S. Pat. No. 4,033,818 describes a detergent composition containing particular species of zinc phthalocyanine as an oxygen bleach activator.

It is also known to use alkali metal chlorites as a bleach. For example it is known to bleach cellulose with sodium chlorite in an acid medium, the chlorite in the acid medium producing chlorine dioxide which is the species responsible for the actual bleaching. Acidic media are generally unsuitable for domestic cleaning processes. It is also known to activate chlorites at high pH with activators such as hydroxylammonium salts (see U.S. Pat. No. 3,836,475) but such activators are expensive and may also be toxic. For these reasons, they have not found commercial success in domestic situations.

It is further known to use alkalimetal chlorites, particularly sodium chlorite, activated by high energy radiation for bleaching fabrics under alkaline conditions (see British patent specification No. 1,397,595). The process for bleaching fabrics according to this British Patent uses electron and $\gamma$-irradiation and substantially high levels of chlorite in the bleaching liquor i.e. chlorite concentrations of 5–500 grams per liter, particularly from 10–110 g/liter. Electron and $\gamma$-rays are high energy rays having an energy of the order of about 300 eV to 15 MeV.

It is thus clear that such a process in view of these high energy rays and its relatively high level of chlorite cannot possibly be applied to the domestic laundering of fabrics, without special and expensive safety precautions.

It is an object of the present invention to provide a particulate detergent composition usable in the domestic laundering of fabrics and comprising a chlorite, which provides a bleaching effect at alkaline or neutral pH without the use of high cost chemical activators and without the use of such high energy electron and $\gamma$-rays.

It has been found surprisingly that a satisfactory bleaching of fabrics can be obtained by using a composition containing a chlorite at levels of much less than 5 g/liter in the wash-liquor, if the liquor containing the composition or fabrics in contact therewith is irradiated with ultra-violet light. Ultra-violet light is a ray of much lower energy than electron and $\gamma$-rays, and hence is much easier to control.

The present invention provides therefore both a method of bleaching fabrics and a formulation for carrying out the method.

Thus, according to a first aspect of the invention there is provided a method of laundering and bleaching fabrics comprising the steps of (a) contacting the fabric with an aqueous liquor comprising from 0.5 to 10 g/l of a composition containing at least 1%, preferably at least 4% by weight of a detersive surfactant with or without a builder, and 0.1% to 40% by weight, preferably from 0.5% to 40% by weight of chlorite, the aqueous liquor having a pH of about 8.5–11;

(b) irradiating the aqueous liquor and/or the fabric in contact therewith with ultra-violet light.

According to the second aspect of the invention there is provided a particulate detergent composition suitable for use in the above method comprising:

(i) at least 1%, preferably from 5–99.5% by weight of a detersive surfactant with or without a builder (ii) 0.1% to 40% by weight, preferably from 0.5–40% by weight of a chlorite, and (iii) less than 20% by weight of water, the composition yielding a pH of about 8.5–11 when dispersed in water at a concentration of 0.5–10 g/l.

The detersive surfactant may be selected from alkali metal soaps, anionic, zwitterionic, amphoteric, semipolar, nonionic or cationic surfactants, and mixtures thereof.

Suitable such surfactant materials are disclosed in Schwartz-Perry: "Surface Active Agents and Detergents", Vol. II, 1958. The amount of surfactant (not counting the builder) may be in excess of about 15%. The detersive surfactant preferably includes a detergency builder in an amount up to about 80%, preferably from 15% to 40% by weight of the composition. The builder may be selected from alkali metal phosphates and carbonates, aluminosilicates and other known inorganic or organic builders.

The chlorite used in the present invention is preferably selected from chlorites of substituted or unsubstituted ammonium, alkali metals (for example sodium potassium or lithium) or alkaline earth metals (for example calcium or magnesium). The preferred material is sodium chlorite.

The composition is in the form of particles, preferably in the form of a free flowing powder, which may be obtained from any powder processing method known in the art, e.g. dry-mixing the ingredients, heat-drying and combinations thereof. A particle size yielding a bulk density of between 0.1 and 1.0 g/cc is suitable.

In use, the composition is dispersed in water to a concentration of between 0.5 g/l and 10 g/l. It is essential that in this dispersed state the composition has a pH of from about 8.5 to about 11.0.

The desired pH may be achieved by the addition of buffering agents, although where the various components of the composition have suitable natural pH, no buffering agent need be added.

The exposure to ultra-violet light may be achieved by exposing the liquor comprising the dispersed composition or the fabrics in contact therewith to daylight or to an artificial source of ultra-violet light. Thus the dispersed composition may be irradiated before contact with the fabrics or while the dispersed composition is in contact with the fabrics, or alternatively the fabrics may be irradiated while in contact with the dispersed composition or thereafter. It is essential that this radiation occurs before the halite is removed, e.g. by rinsing, from the fabrics. The ultra-violet light preferably has a component with a wavelength of between about 200 nm and about 400 nm, most preferably less than 370 nm. The intensity of the ultra-violet light, as measured at the fabric surface or at the surface of the liquor is preferably from about 0.01 to about 10.0, more preferably from about 0.05 to about 0.2 $Wm^{-2}\ nm^{-1}$. Typical bright sunlight has an intensity over most wavelengths of 0.1–0.2 $Wm^{-2}\ nm^{-1}$. Under these conditions a suitable exposure time is between about 10 minutes and about 10 hours, more preferably between about 30 minutes and about 4 hours, depending on the concentration of the chlorite in the liquor and on the degree of bleaching required. The preferred light intensity can alternatively be expressed as from about $10^{-1}$ to about $10^{-6}$, preferably from about $10^{-2}$ to about $10^{-4}$ Einsteins of energy in the 200 nm to 370 nm wavelength region per liter of liquor.

The detergent composition may contain one or more ingredients other than those specified above, for example, other bleaches, bleach precursors and colourants, including photoactivated bleaches such as sulphonated zinc phthalocyanine, antifoaming agents, antiredeposition agents, perfumes, perfume carriers, enzymes, organic solvents, optical brightening agents, thickeners, fillers, preservatives, dyes, electrolytes, powder processing aids, colouring agents and whitening agents.

Preferred optical brightening agents are disodium-4,4'-bis(2-sulphostyryl)-biphenyl and disodium-4,4'-bis(4-phenyl-1,2,3-triazol-2-yl)-2,2'-stilbene disulphonate.

The composition, before use, should contain substantially no material which in the aqueous liquor will react with and remove the chlorite ions. Thus chlorite ions are known to react with chlorine or chlorine producing materials such as calcium hypochlorite or sodium dichloroisocyanurate to produce chlorine dioxide. Thus, the composition preferably contains, for each part by weight of chlorite, less than 0.4 parts, advantageously less than 0.1 part by weight of a material which in aqueous media in the absence of UV-light reacts to a substantial extent with the chlorite ions, that is reacts with at least a major proportion of the chlorite ions.

In order to achieve adequate soil removal from the substrate, in addition to bleaching, it is desirable that the ratio of the total weight of the surfactant and builder (when present) to the weight of the chlorite yielding material is in excess of 1:1, preferably in excess of 3.5:1, ideally in excess of 5.0:1.

The invention will now be illustrated by the following non-limiting Examples in which percentages and parts are by weight unless otherwise specified.

In the following Examples 1 to 3, a pyrex cell was partially filled with a treatment liquid, made up as specified in the particular Example. Heavily tea-stained cloths were immersed in the treatment liquid. The cell was then placed in the chamber of an Atlas Weatherometer which had been adjusted to an output to simulate solar radiation, both in intensity and energy distribution. The chamber had an initial temperature of about 22° C. After irradiating the cloths from one side for a selected time the percentage reflectance at 460 nm was measured using a Zeis "Elrepho" reflectometer fitted with a UV-filter and the reflectance change, ΔR460*, was determined by comparing the measured reflectance of the treated cloth with that of the same cloth before treatment. The treated cloths were monitored; both those regions of the cloths which were immersed in the treatment liquid and of those regions of the cloths which were suspended above the treatment liquid and which were contacted with the treatment liquid only as a result of capillary action from the immersed regions. Reflectance changes of both the front and the back of each cloth were measured.

The totally immersed cloth simulated a method of washing fabrics in a washing machine which incorporates a source emitting UV-light or bowl washing in daylight, whereas the suspended cloth simulates a re-wet sun-bleaching operation.

EXAMPLE 1

A known fabric washing powder was used having the following approximate formulation:

| Ingredient | parts |
|---|---|
| Alkyl benzene sulphonate | 16 |
| Coco ethanolamide | 3 |
| Sodium toluene sulphonace | 2 |
| Sodium tripolyphosphate | 35 |
| Sodium silicate | 11 |
| Sodium sulphate | 10.55 |
| Water | 9.1 |

Treatment liquids were prepared by dispersing this powder in demineralised water at a concentration of 4.5 g/l and adding sodium chlorite. The pH of the treatment liquid containing the sodium chlorite was between 8.5 and 11.0. Control liquids were prepared in an identical manner, but without chlorite.

The results obtained are set out in the following Table 1.

TABLE 1

| Chlorite Concentration | Irradiation Time | Δ R460* Suspended cloth Front | Suspended cloth Back | Immersed cloth Front | Immersed cloth Back |
|---|---|---|---|---|---|
| 0 | 0 | −0.2 | −0.2 | −0.2 | −0.2 |
| 0 | 1 hour | −0.2 | 1.2 | −1.0 | 0.1 |
| 0 | 2 hours | 4.9 | 0.1 | 3.0 | 1.0 |
| 0.5 g/l | 0 | −0.1 | −0.1 | −0.1 | −0.1 |
| 0.5 g/l | 1 hour | 1.7 | 1.1 | 3.0 | 1.0 |
| 0.5 g/l | 2 hours | 8.0 | 4.0 | 12.0 | 7.0 |

These results demonstrate the effect of the combination of liquid containing sodium chlorite and irradiation with light containing ultra-violet wavelengths. The totally immersed cloth simulates a method of washing fabrics in a washing machine which incorporates a source emitting UV-light or bowl washing in daylight. The suspended cloth simulates a re-wet sun-bleaching operation.

EXAMPLE 2

Example 1 was repeated using a powder having the following approximate formulation:

| Ingredient | parts |
|---|---|
| Alkyl benzene sulphate | 6 |
| Fatty alcohol ethoxylate | 4 |
| Sodium soap | 7 |
| Sodium tripolyphosphate | 31 |
| Water and minor ingredients (less than 15% water) | 25 |

The results obtained are set out in the following Table 2.

TABLE 2

| Chlorite Concentration | Irradiation Time | Δ R460* Suspended Cloth Front | Suspended Cloth Back | Immersed Cloth Front | Immersed Cloth Back |
|---|---|---|---|---|---|
| 0 | 0 | 0.5 | 0.5 | 0.5 | 0.5 |
| 0 | 1 hour | −1.2 | −1.5 | 2.1 | −1.7 |
| 0 | 2 hours | 2.4 | 0.6 | 4.4 | 0.2 |
| 0.5 g/l | 0 | 0.4 | 0.4 | 0.4 | 0.4 |
| 0.5 g/l | 1 hour | 1.3 | −0.4 | 0.2 | −1.5 |

TABLE 2-continued

| Chlorite Concentration | Irradiation Time | Δ R460* Suspended Cloth Front | Suspended Cloth Back | Immersed Cloth Front | Immersed Cloth Back |
|---|---|---|---|---|---|
| 0.5 g/l | 2 hours | 4.5 | 1.1 | 4.6 | 0 |

EXAMPLE 3

Example 1 was repeated using a soap-based powder of the following approximate formulation:

| Ingredient | parts |
|---|---|
| Sodium soap | 43 |
| Sodium tripolyphosphate | 8 |
| Sodium carbonate | 2 |
| Water and minor ingredients (less than 15% water) | 22 |

The results are given in the following Table 3.

TABLE 3

| Chlorite Concentration | Irradiation Time | Δ R640* Suspended Cloth Front | Suspended Cloth Back | Immersed Cloth Front | Immersed Cloth Back |
|---|---|---|---|---|---|
| 0 | 0 | 0.2 | 0.2 | 0.2 | 0.2 |
| 0 | 1 hour | 1.1 | −0.1 | −0.1 | −1.5 |
| 0 | 2 hours | 2.0 | 1.9 | −0.1 | 1.3 |
| 0.5 g/l | 0 | −0.2 | −0.2 | −0.2 | −0.2 |
| 0.5 g/l | 1 hour | 3.4 | −0.2 | −0.3 | 0.2 |
| 0.5 g/l | 2 hours | 4.6 | 0.4 | 2.1 | −0.5 |

A suitable machine for carrying out the present invention comprises a vessel adapted to hold the liquor and the fabrics, means for providing relative movement between the liquor and the fabrics, and at least one light source adapted to irradiate at least part of the liquor and/or the fabrics in contact with the liquor, the or each said light source emitting light of wavelength less than 400 nm.

The machine may comprise means for maintaining the liquor temperature at a desired value, such as heating means.

Optionally the or each said light source is mounted on a wall portion of the vessel or on a closure lid or door therefor. Alternatively or additionally, the or each said source is mounted adjacent a chamber through which the liquor is circulated, enabling the liquor to be irradiated prior to its contact with the fabrics. Such a chamber should include at least one wall which is transparent to ultra-violet light, preferably down to 300 nm, although it is possible for this wall to be opaque to visible light. A suitable material for the transparent wall is pyrex.

The machine may have the features of any suitable type of domestic or commercial fabric washing machine. For example, a fixed tube in which the contents of the tub are agitated by a paddle or a pulsator cylinder containing the articles to be washed revolves with a fixed cylinder which holds the wash liquor.

The activation of the light(s) can be controlled by (an) appropriate device(s) according to the wash problem. For example, when white cotton loads are being washed, the light(s) will normally be activated at some stage of the process. When washing, for example, wool, illumination and therefore bleaching, will usually be excluded.

The time periods of illumination will also be determined by the wash problem. For example, in certain programmes using enzyme containing washing powders, it may be desirable to complete one or more stages of the wash process before beginning illumination/-bleaching.

The timing and degree of illumination may be predetermined by the programming device or may be controlled by appropriate sensors for parameters such as temperature, optical density and/or pH.

The ultra-violet light source may, for example, be of the quartz-iodine, xenon or mercury discharge types. A 400 W mercury-iodine lamp would be particularly suitable, positioned so that the light would be incident in use on the glass/liquor interface.

What is claimed is:

1. A method of laundering and bleaching fabrics comprising the steps of (a) contacting the fabric with an aqueous liquor comprising from 0.5 to 10 g/l of a composition containing 5 to 99.5% by weight of a detersive surfactant including a builder in an amount up to 80% by weight and 0.1% to 40% by weight of a chlorite, the aqueous liquor having a pH of 8.5–11; and (b) irradiating the aqueous liquor or the fabric in contact therewith with ultra-violet light having a wavelength of 200 to 400 nm.

2. A method according to claim 1, wherein the ultra-violet light has a component having a wavelength of from about 200 nm to not more than 370 nm.

3. A method according to claim 1, wherein the ultra-violet light has an intensity of from about 0.01 to about 10.0 $Wm^{-2} nm^{-1}$.

4. A method according to claim 1, wherein the aqueous liquor or fabric in contact therewith is irradiated for a period of from about 10 minutes to about 10 hours.

5. A method according to claim 1, wherein the aqueous liquor or fabric in contact therewith is irradiated by exposure to daylight.

* * * * *